US007444950B2

(12) United States Patent
Ganem

(10) Patent No.: US 7,444,950 B2
(45) Date of Patent: Nov. 4, 2008

(54) PRODUCTION PROCESSES USED FOR MAKING POLYAMIDE FIBER WOOF

(76) Inventor: Marcia Luiza Freitas Ganem, Praia de Icaraí, 237 apto 1301-B, Icaraí, Niterói, RJ (BR) 24230-003

( * ) Notice: Subject to any disclaimer, the term of this patent is extended or adjusted under 35 U.S.C. 154(b) by 618 days.

(21) Appl. No.: 10/507,766

(22) PCT Filed: Mar. 18, 2003

(86) PCT No.: PCT/BR03/00040

§ 371 (c)(1),
(2), (4) Date: Sep. 15, 2004

(87) PCT Pub. No.: WO03/078712

PCT Pub. Date: Sep. 25, 2003

(65) Prior Publication Data

US 2005/0223960 A1 Oct. 13, 2005

(30) Foreign Application Priority Data

Mar. 19, 2002 (BR) ..... 0203095

(51) Int. Cl.
*D05B 35/06* (2006.01)
*D05B 53/00* (2006.01)
*D05B 93/00* (2006.01)

(52) U.S. Cl. ..... 112/475.01; 112/415; 428/102

(58) Field of Classification Search ..... 112/475.01, 112/475.08, 402, 403, 412, 415; 428/102
See application file for complete search history.

(56) References Cited

U.S. PATENT DOCUMENTS 3,974,025 A * 8/1976 Ayers ..... 162/113
4,416,929 A * 11/1983 Krueger ..... 428/102
4,664,961 A * 5/1987 Vees et al. ..... 428/102
6,099,026 A * 8/2000 Ando et al. ..... 280/728.3
6,165,586 A * 12/2000 Nouveau et al. ..... 428/105

* cited by examiner

*Primary Examiner*—Ismael Izaguirre
(74) *Attorney, Agent, or Firm*—Fildes & Outland, P.C.

(57) ABSTRACT

Polyamide fiber is used for its high resistance properties, where together with the described processes for producing polyamide fiber woof, the result is a strong, resistant and versatile material. There are two main processes for producing polyamide fiber woof: 1. Substituting the fine, cotton, transversal threads in the original polyamide fibre strong, secure, transversal sustaining stitching. 2. By the process of net woofing. The invention uses as its starting material, raw and vulcanized polyamide fiber weave. This is found as refuse from the process of manufacturing tires and seat belts. Polyamide fiber woof is suitable for use in clothes, shoes, jewels, jewelry, wigs and objects of decoration and art.

4 Claims, 4 Drawing Sheets

PRODUCTION PROCESSES USED FOR MAKING POLYAMIDE FIBER WOOF

FUNDAMENTALS OF THE INVENTION

The invention refers to the processes used for the production of polyamide fibre woof. The processes uses raw polyamide fibre weave and vulcanized polyamide fibre weave. These fibre weaves are fabricated by the polymer producing industries. The polyamide fibre weaves are originally produced in order to be used in the fabrication of seatbelts and the inner parts of tires. Polyamide fibre has a very high resistance index and for this reason, is used for making products that need to withstand high levels of traction.

However, although the longitudinal polyamide fibre threads in the polyamide fibre weave are highly resistant, the transversal composition of the weave is made of tenuous cotton threads, of low resistance. Due to this fact, the polyamide fibre weave tends to come undone with time. And for this reason, without further processing, the use of the weave is limited. But by removing the tenuous, cotton threads and using just the polyamide fibre threads, the highly resistant threads can be used in various areas, such as fashion and decoration. Within the polymer producing industries, every polyamide fibre weave has to go through quality control procedures. Any defects result in the rejection and discarding of the weave, creating off spec products.

This refuse, therefore, appears to be an inherent part of the production system.

With the objective of utilizing these highly resistant fibres refuse, which are largely and usually seen in these systems, a process was developed, by which raw and vulcanized polyamide fibre weave is transformed into polyamide fibre woof, in sense of to identify the best and more suitable utilization for these refuses.

This thus opens up new possibilities for the utilization of these fibres and also for reducing the serious problems of accumulation of industrial wastes.

SUMMARY OF THE INVENTION

Polyamide fibre woof is made using raw or vulcanized polyamide fibre weave, made by the polymer producing industries, for use in the fabrication of seatbelts and the inner part of tyres, specially the off spec grades.

Polyamide fibre woof is then created, by either a process of substituting the tenuous, cotton, transversal threads for strong, sustaining, transversal stitching, or by a process of woof netting.

Polyamide fibre woof as produced by these invented processes has the important characteristic of being highly resistant. This is due to the high resistance of the polyamide fibre threads, together with the processes used for making the woof. Consequently, the woof can be used in areas such as clothing, bags, shoes, jewelry, jewels, wigs, decoration and art.

DEFINITIONS

As used here, the term "raw polyamide fibre weave", is defined as a weave made of longitudinal, polyamide fibre threads, interwoven transversally with fine, tenuous, cotton threads. As used here, the term "vulcanized polyamide fibre weave", is defined as raw polyamide fibre weave that has been immersed in a mixture of latex, resourscinal, formoldine and ammonia, adding a coating to the raw polyamide fibre weave.

As used here, the term "transversal sustaining stitching", is defined as strong, secure, transversal stitching that holds together the longitudinal, polyamide fibre threads. This stitching is done over an individual, transversally placed polyamide fibre thread and is done mechanically, using a sewing machine. For this, please see details in the figure number 1.

As used here, the term "woof netting" is defined as a process for making a handmade, netted woof. The netted woof is a structure of threads, connected by a braid and joined by knots. See FIG. 4

As used here, the term "clothing" includes any types of clothing, such as dresses, bermudas, coats, and others, as well as shoes.

DETAILED DESCRIPTION OF THE PROCESS

There are basically two processes for producing a polyamide fibre woof; a manual process and a mechanical process.

By the mechanical process, polyamide fibre woof is made by substituting the tenuous, cotton, transversal threads in the raw and vulcanized polyamide fibre weave, for secure, transversal, sustaining stitching, using a sewing machine.

The transversal, sustaining stitching is achieved by placing an individual, fibre thread transversally over the longitudinal fibres and fixing it with a sewing machine, using a strong, thick stitch.

The sustaining transversal stitching is applied at regular distances apart. This distance varies between four to fifteen centimeters, depending on the piece to be made.

In the manual method, the netted polyamide fibre woof is made with individual, polyamide fibre threads, connected by knots in a regular, repetitive way, like a fish net.

Under these two basic processes, the examples which follow, demonstrate all the production processes used for making polyamide fibre woof.

EXAMPLE 1

Producing polyamide fibre woof by the mechanical method: Firstly, a piece of raw or vulcanized polyamide fibre weave is cut to the size required for the piece to be made. The weave is only cut widthways, following the direction of the transversal, cotton threads.

Figure 1:
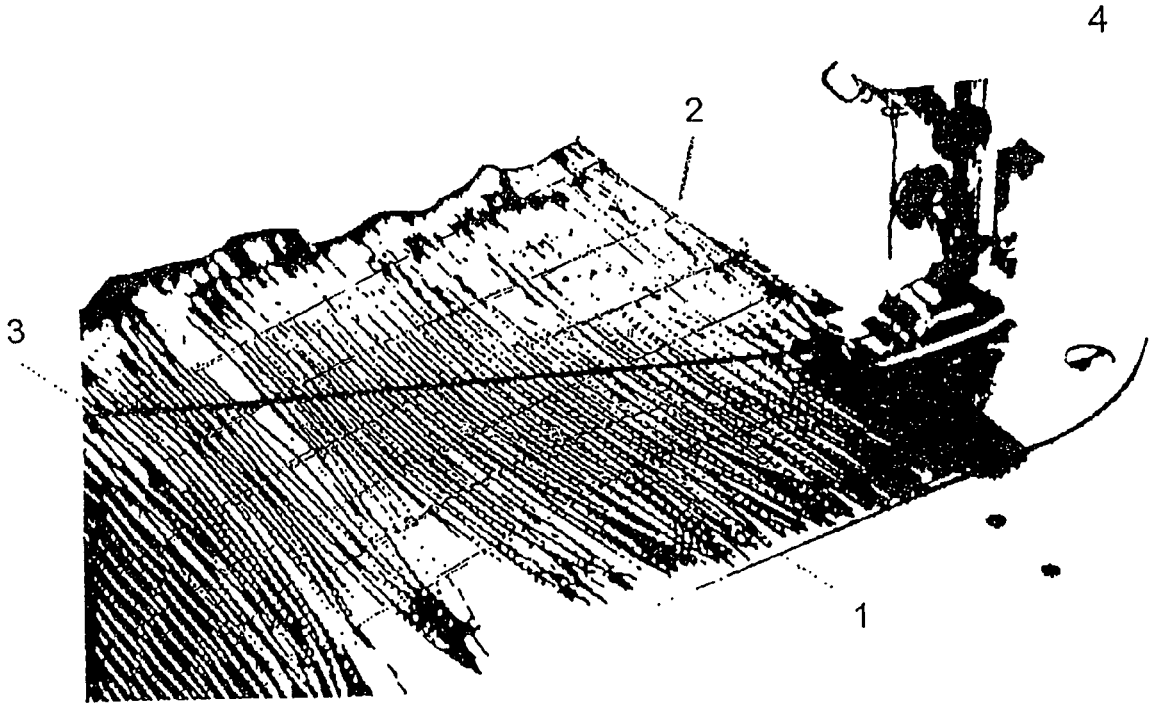
In FIG. 1, we can see the structure of individual, longitudinal fibres of the weave; 1. With fine, cotton threads woven between them; 2. With a single, polyamide, fibre thread being placed transversally over the longitudinal threads; 3. Being placed on the sewing machine; 4. With the transversal sustaining stitching being applied, replacing the fine, cotton threads, the result, as shown in FIG. 2.
Figure 2:
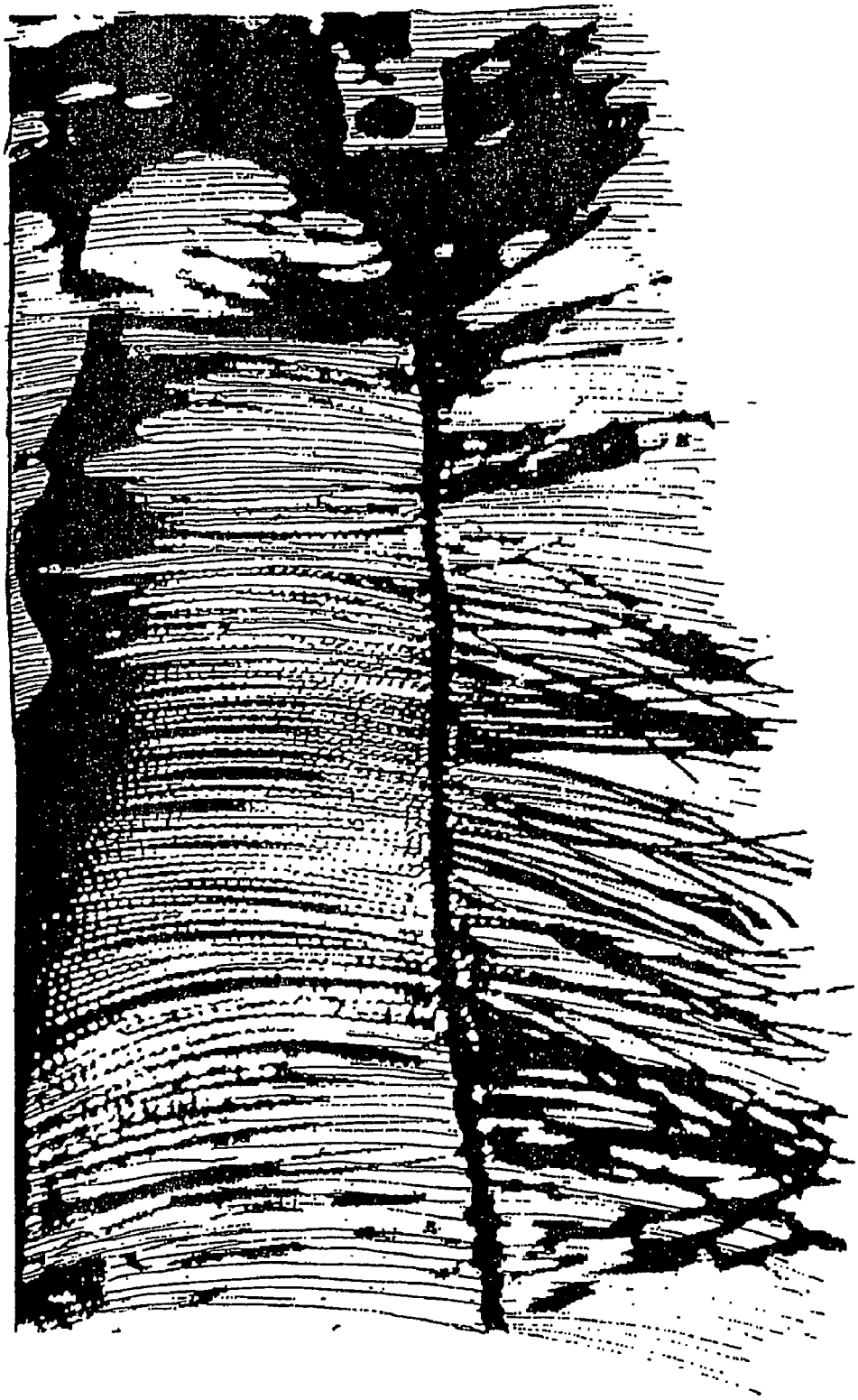
Figure 3:
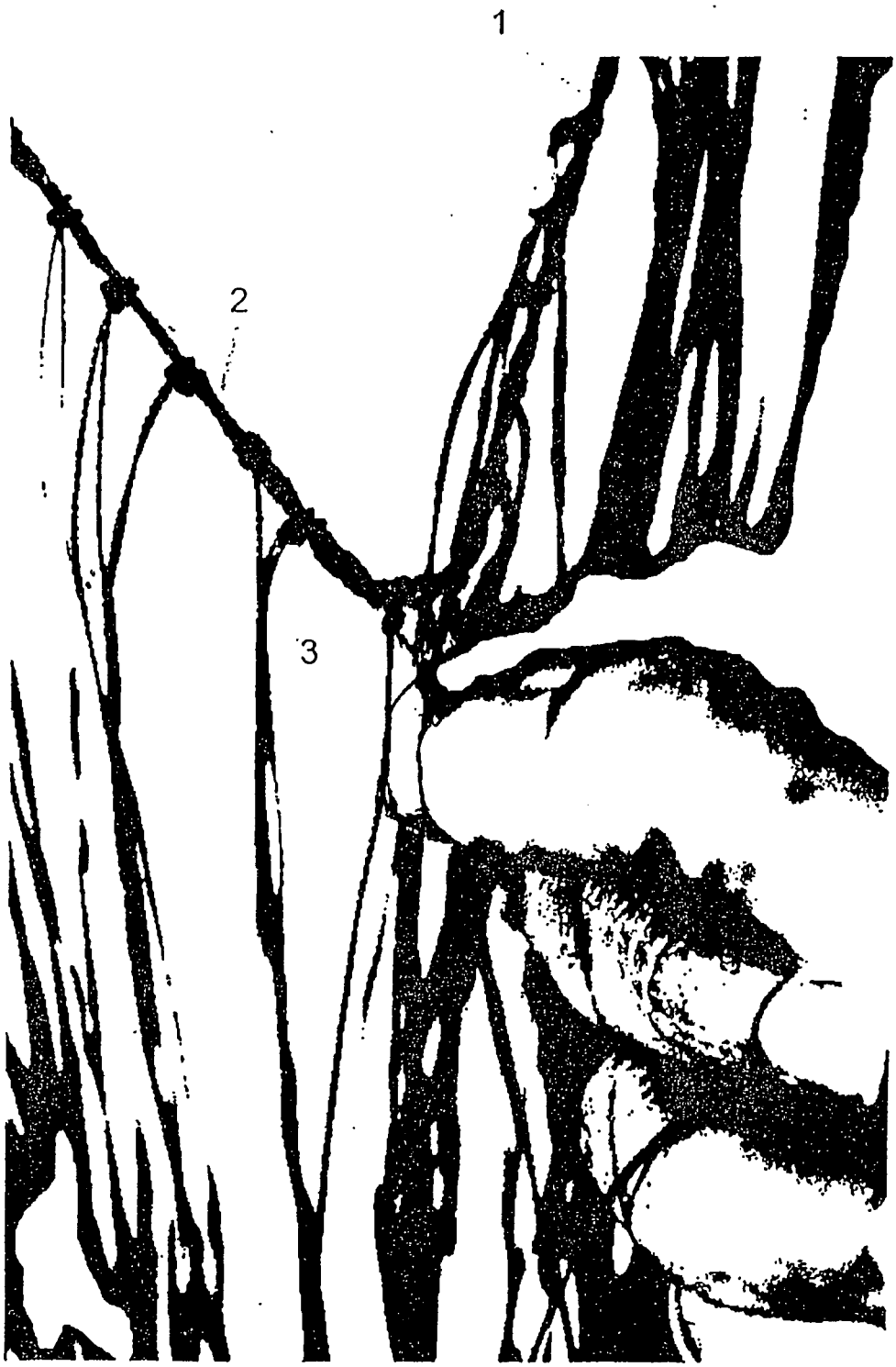
In FIG. 3, we can observe a fibre braid from which 1. The individual fibre threads are connected 2. And will be connected between themselves, by knots, forming a sequential chain, the result as shown in FIG. 4.
Figure 4:
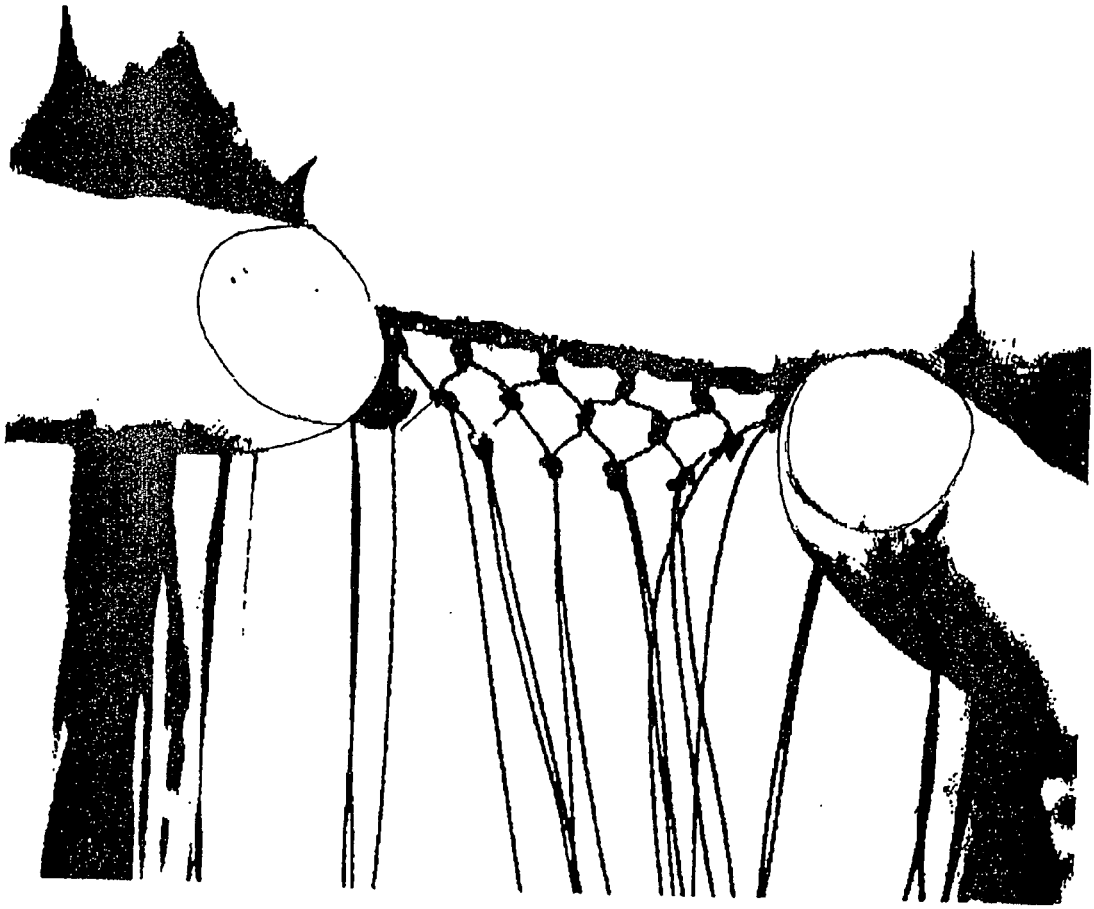

The weave is extended widthways on the sewing machine. One fibre thread is placed over the weave in the direction of the transversal, cotton threads. The sewing machine is then used to stitch it, with strong, secure, sustaining transversal stitching. See FIGS. 1 and 2.

The transversal sustaining stitching is run the whole width of the weave, on both sides and is repeated at regular intervals, between four to fifteen centimeters, depending on the piece to be made.

After applying the transversal sustaining stitching, the remaining tenuous, transversal, cotton threads are picked out and removed. The woof is now complete and ready for making the desired piece.

EXAMPLE 2

Producing polyamide fibre woof by the mechanical method, with lining: A piece of raw or vulcanized, polyamide fibre weave is cut to the required size. A piece of equal sized material is also cut, to be used as the lining. The weave is placed over the material, width ways on the sewing machine. The transversal sustaining stitching is then completed as in example one. However, this time, the stitching also goes through the lining, attaching it to the polyamide fibre weave.

EXAMPLE 3

Producing polyamide fibre woof by the manual method: polyamide fiber woof is created by unweaving the piece of raw or vulcanized, polyamide fibre weave, putting the individuals threads on tress, fixed in a parallel way and in a continuous space, in order to be linked by knots, as a net.

The knots are made at the mid-distance between the two threads used in the knot. The knots are also made at the same distance down the length of the thread on the two threads. The distance between the knots is decided, so that it can be maintained in making the woof.

EXAMPLE 4

Producing polyamide fibre woof by the manual method, using gems: The netted woof is produced as described in example three.

However, in this case, gems are inserted into the knot spaces. The size of the knot space is made relative to the distance to the mid-point between the two threads used in the knot. The size of the knot space for the gems, as well as the distance between the knots, is maintained regular and symmetrical, throughout the woof.

This procedure is repeated to the inferior rows, making the sequence of knots of the whole woof.

The invention claimed is:

1. Process for the production of polyamide fibre woof, using the refuse of raw or vulcanized polyamide fibre weave, characterized by substitution of transversal cotton threads in the weave for secure, transversal sustaining stitching, done with a sewing machine wherein said transversal sustaining stitching has a base of a transversally placed fibre thread and runs the whole length of the woof, said transversal sustaining stitching is repeated at regular distances apart, the distances being determined by the design of the piece to be made, and after sewing said transversal sustaining stitching, said cotton threads are picked out and removed.

2. Process for the production of polyamide fibre woof according to claim 1, characterized by manually interlinking individual fibre threads sequentially with knots.

3. Process for the production of polyamide fibre woof according to claim 2, characterized by regular and symmetrical knot spacing to accept gems inserted into the knot spaces.

4. An article formed by the process of claim 1.

* * * * *